United States Patent [19]

Goldman et al.

[11] 4,397,579

[45] Aug. 9, 1983

[54] EXPANSION JOINT STRUCTURES

[75] Inventors: Gerald L. Goldman; Joseph W. Gallagher; William A. Merlack, all of Pittsburgh, Pa.

[73] Assignee: Columbia Chase Corporation, Braintree, Mass.

[21] Appl. No.: 271,259

[22] Filed: Jun. 8, 1981

[51] Int. Cl.[3] ..... E01C 11/02

[52] U.S. Cl. ..... 404/60; 404/66; 404/68; 14/16.5

[58] Field of Search ..... 404/47, 60, 63, 64, 404/65, 66, 67, 68; 14/16.5

[56] References Cited

U.S. PATENT DOCUMENTS

| | | | |
|---|---|---|---|
| Re. 26,733 | 12/1969 | Welch | 14/16.5 X |
| 3,165,986 | 1/1965 | Hirst et al. | 404/47 X |
| 3,273,473 | 9/1966 | Pare | 14/16.5 X |
| 3,316,574 | 5/1967 | Pare | 14/16.5 |
| 3,520,236 | 7/1970 | Sequaris | 14/16.5 X |
| 3,555,982 | 1/1971 | George | 14/16.5 X |
| 3,717,969 | 2/1973 | Sequaris | 404/68 X |
| 3,720,474 | 3/1973 | Stog et al. | 404/47 |
| 3,797,188 | 3/1974 | Mansfeld | 52/396 |
| 3,797,952 | 3/1974 | Pommerening et al. | 404/68 X |
| 3,854,835 | 12/1974 | Stog | 404/68 |
| 3,899,261 | 8/1975 | Mieville | 404/68 |
| 4,015,302 | 4/1977 | Clark | 404/47 X |
| 4,022,538 | 5/1977 | Watson et al. | 404/67 X |

FOREIGN PATENT DOCUMENTS

| | | | |
|---|---|---|---|
| 2389714 | 5/1978 | France | 404/47 |

*Primary Examiner*—William F. Pate, III
*Assistant Examiner*—Beverly E. Hjorth
*Attorney, Agent, or Firm*—Buell, Blenko, Ziesenheim & Beck

[57] ABSTRACT

An expansion joint and seal structure for the variable width space between roadway, bridge or like sections subject to expansion and contraction is provided in the form of an elongate elastomer member having spaced transverse passages of generally rectangular cross section with rounded corners in which metal bars of like cross section but shorter length are inserted, both the passages and bars have cooperating indexing devices which center the bars in each passage spaced equidistant from the ends thereof so as to maintain them over the space between the roadway, bridge or like sections.

20 Claims, 12 Drawing Figures

EXPANSION JOINT STRUCTURES

This invention relates to expansion joint structures and particularly to water proof expansion joints for bridge, roadways and similar structures.

The need for expansion joint structures between segments of bridge decking and between bridge decking and an adjacent road surface are well known and long recognized. Typical prior art expansion joints have been made with interdigiting metal figures on the two adjacent ends or with a metal tongue or flaps fixed to one end and slidingly overlying the adjacent deck end. These devices are subject to excessive corrosion and various other problems, particularly in areas of high salt concentration such as snow belt areas where snow removal by salting is practiced or in coastal areas where sea spray can reach them. In an effort to overcome these problems a variety of devices have been proposed to protect the metal load bearing members forming the expansion joint. For example Hirst et al. U.S. Pat. No. 3,165,986 provides interdigiting metal figures attached to each adjacent end of bridge decking covered by an overlay or rubber mat reinforced with elongate transverse bars resting on the interdigiting figures. Mansfield U.S. Pat. No. 3,797,188 provides a shoulder on each deck end spaced from each other, a tee member overlying the gap and an accordion shaped rubber sealing member covering the entire assembly. Pommerening et al. U.S. Pat. No. 3,797,952 provides a lazy tongs assembly connected at opposite ends to the adjacent ends of bridge decking, a plurality of bars supported on the lazy tongs and rubber seal member between the bars. Pare U.S. Pat. No. 3,316,574 provides a molded elastomer sheet having an elongate bar of sufficient width to span the opening between the deck ends molded therein and extending parallel to the opening between the deck ends. George U.S. Pat. No. 3,555,982 also provides a molded elastomer sheet but provides a plurality of side-by-side rods transverse to the slot between the deck ends in openings in the rubber. The bars are shorter than the openings in the rubber so that the rubber can move in expansion and contraction without the deck ends touching the rods. Sequaris U.S. Pat. No. 3,520,236 is similar in structure to Pare and provides an elongate plate covered by an elastomer sheet. Mieville U.S. Pat. No. 3,899,261 provides a rubber member with cavities and metal bars therein similar to the George patent. The Stog et al. U.S. Pat. No. 3,720,474 and Sequaris U.S. Pat. No. 3,717,969 show very similar structure in which an elastomer member is provided with a plurality of spaced reinforcing members in slots in the bottom running parallel to the ends of the decking and the slot between them. All of these devices are subject to some of the ills of the earlier prior art devices. For example, the metal pieces of Hirst et al., Mansfield, Pommerening et al., some forms of Pare, Sequaris, Mieville and Stog et al. are all exposed to the elements from below, albeit covered at the top. The George patent provides complete coverage of the rods but the rods as used by George have a high degree of deflection and the rod ends cause serious problems of cutting and excess tension on the rubber and there is no way to center them. We have invented an expansion joint structure which eliminates all of the problems of the foregoing structures. We provide a structure in which corrosion damage is minimal. In the structure of this invention the deflection at the joint is very small and there is no damage of significance to the elastomeric body of the seal by internal movement of metal reinforcing members.

The present invention provides an expansion joint and seal structure for the variable width space between a pair of roadway or bridge sections which are subject to expansion and contraction with temperature changes and which have a pair of juxtaposed recessed support panels comprising an elongate elastomeric member with generally parallel side marginal edges, and generally parallel top and bottom surfaces, a plurality of spaced apart transversly extending generally rectangular passages extending through the elastomer member from one marginal edge to the other intermediate the top and bottom surfaces, each of said openings having an inwardly extending projection on at least one side, a series of metal load bearing members having the general shape of the transversely extending passage and slidable therein, said metal load bearing members having a recess corresponding to and engaged by the projection and being shorter than the length of the passage, said recess and projecting spacing and maintaining the ends of the load bearing member substantially equally distant from the two marginal edges, said load bearing members having a length sufficient to span the space between the roadway or bridge sections and to overlie a portion of each recessed support panel at all times, means for fastening the side marginal edges of said elastomer member to the pair of roadway or bridge sections and a plurality of spaced slots actually on both edges and top and bottom surfaces to permit better expansion and contraction of the elastomer member. Preferably the generally rectangular transverse passage is rounded at the corners to provide a generally long flat oval section and the load bearing members have the same cross section. The load bearing members are preferably cast members of high strength steel. The projections in the passage are preferably on each side equidistant from the marginal edges. The fastening means is preferably an H-shaped metal member having a transverse threaded projection extending out of the marginal side edge between each passage with the H member on its side with the legs of the H extending partially above and below adjacent passages and the threaded projection being fastened in openings in a retaining member on each recessed support panel. Preferably both the top and bottom and marginal side edges are provided with parallel spaced slots and adjacent projections which permit more uniform and regular expansion and contraction of the elastomer member.

In the foregoing general description of this invention certain objects, purposes and advantages of the invention have been set out. Other objects, purposes and advantages of this invention will be recognized from the following description and the accompanying drawings in which.

Figure 1:
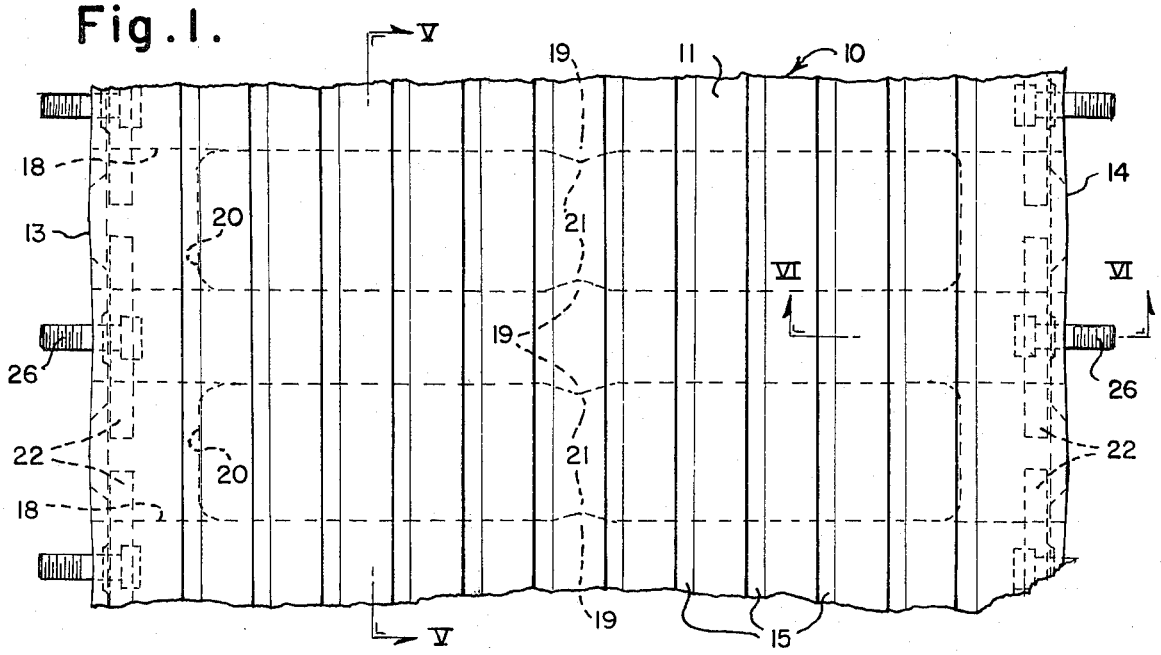
FIG. 1 is a fragmentary top plan view of an expansion joint structure according to this invention.
Figure 2:
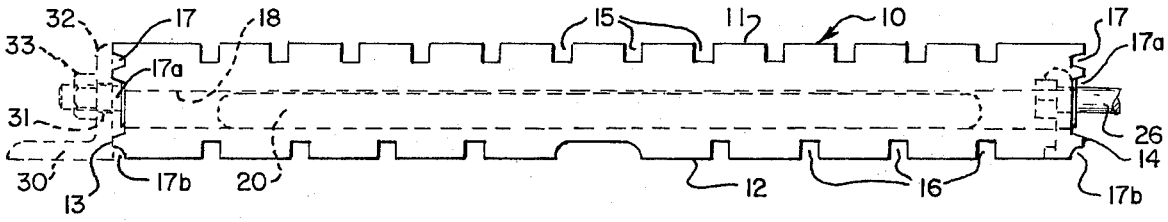
FIG. 2 is an end elevational view of the expansion joint structure of FIG. 1.
Figure 3:
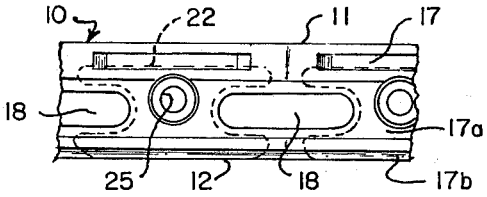
FIG. 3 is a fragmentary side elevational view of the expansion joint structure of FIG. 1.
Figure 6:
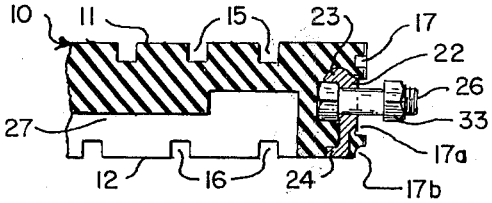
FIG. 6 is a fragmentary section on the line VI—VI of FIG. 1.
Figure 5:
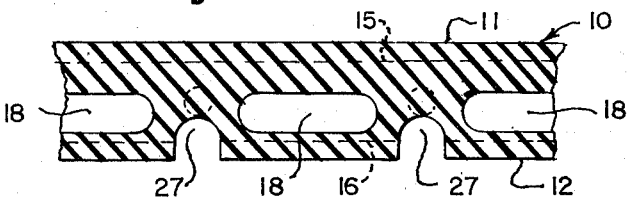
FIG. 5 is a section on the line V—V of FIG. 1.
Figure 4:
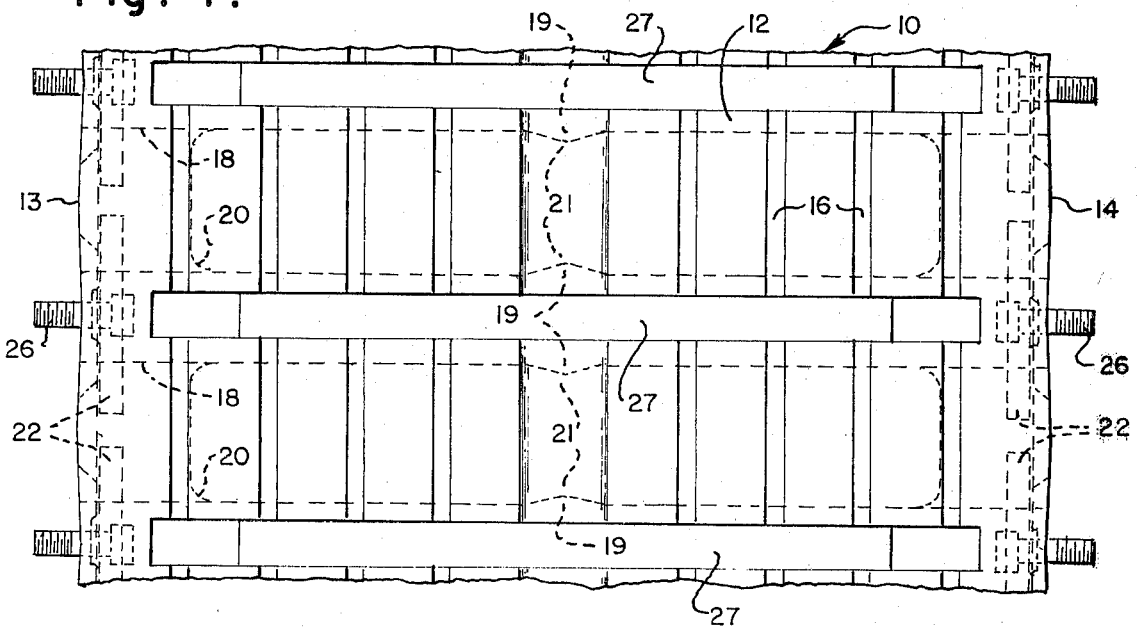
FIG. 4 is a bottom plan view of the joint structure of FIG. 1.
Figure 7:
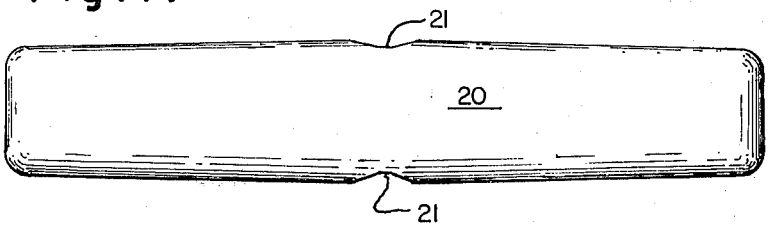
FIG. 7 is a plan view of a load bearing bar used in FIG. 1.
Figure 9:
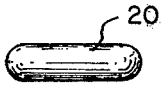
FIG. 9 is an end elevational view of the bar of FIG. 7.
Figure 8:
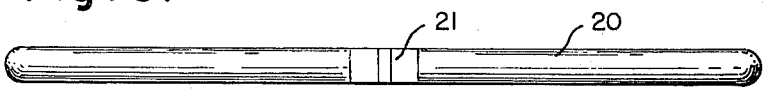
FIG. 8 is a side elevational view of the bar of FIG. 7.
Figure 11:
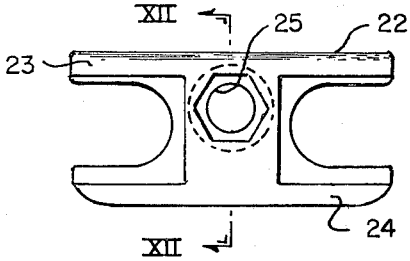
FIG. 11 is a side elevational view of the H-shaped member of FIG. 10.
Figure 10:
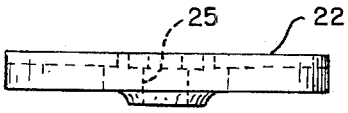
FIG. 10 is a top plan view of the H-shaped metal fastener member used in the embodiment of FIG. 1.
Figure 12:
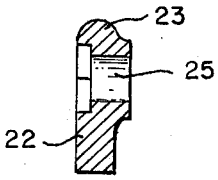
FIG. 12 is an end sectional view of the H-shaped member of FIG. 10.

Referring to the drawings there is illustrated an expansion joint structure having an elongate elastomer member 10 with top 11 and bottom 12 surfaces and spaced marginal side edges 13 and 14. The top 11 and bottom 12 are provided with generally parallel spaced slots 15 and 16 extending lengthwise of the elastomer member. The side edges are also preferably provided with spaced parallel end slots 17, 17*a* and 17*b* extending lengthwise of the elastomer member. The side slots 17, 17*a* and 17*b* provide for ease of compression of side edges 13 and 14 in order to accomplish sealing of elastomer steel interface along the edge of the expansion joint. The slots at top and bottom 11 and 12 provide areas for movement of the elastomer during expansion and contraction. The dimension of the elastomer strip will depend upon the size of the joint being covered, the general climatic conditions and the loading. A plurality of equally spaced elongate oval passages 18 extend from one side edge 13 to the other 14 intermediate the top 11 and bottom 12 surfaces. Each passage 18 has a pair of indexing projections 19 extending into the passage at the midpoint of its length, an elongated flat cast graphitic steel bar 20 having indentations 21 at the midpoint of its length corresponding to projections 19 is inserted in each passage 18 until the projection 19 engages the indentations 21 indexing the bar in the passage 18. Each bar 20 is slightly shorter than the passage 18 but is sufficiently long that it always spans the space between a pair of bridge or road surfaces to be covered by the expansion joint. The bars 20 are thus fixed in position after insertion in passages 18 by the indexing projection 19 and indentations 21 and are not free to move lengthwise in the passage, except that they can expand and contract freely within passage 18 relative to the surrounding elastomer. Retainer plates 22 of a generally H-shape, having reinforcing ribs 23 on one leg and 24 on the other leg and an opening 25 carrying a bolt 26 are either molded into the elastomer at each marginal side edge with the bolt end projecting or they are inserted in preformed pockets in the elastomer. The retainer plates are designed so that the H configuration when on its side will extend at least partially around adjacent passages 18 (see FIG. 3). A transverse slot 27 extends across the bottom surface 12 of the elastomer member in parallel alignment with the axis of bolts 26 at each end and intersecting slots 16. The rib 24 and corresponding leg of the retainer plate are designed to rest on the supporting surface of the support panel 30 along with the bottom surface 12 of the elastomer member. This prevents a load on the top surface from placing a shearing force on the bolt head.

The elastomer member is fastened to a support member 30 which may be a steel plate, a concrete edge face, or the like, by the bolts 26 passing through holes 31 in an elongated angle bar 32 which are, in turn, fastened with nuts 33. This prevents the joint between the elastomer member 10 and the angle bar 32 from separating under tension. This sealing effect is also enhanced at the marginal side edges 13 and 14 by molding one parallel slot 17 above and one slot 17*b* below the bolt 26 as wlll as a third slot 17*a* at the bolt itself. These slots permit the rubber to compress and provide the maximum sealing effect.

In the foregoing specification certain preferred practices and embodiments of this invention have been set out. However, it will be understood that this invention may be otherwise embodied within the scope of the following claims.

We claim:

1. An expansion joint and seal structure for the variable width space between a pair of roadway, bridge or like sections which are subject to expansion and contraction with temperature changes comprising an elongate elastomeric member with generally parallel side marginal edges and generally parallel top and bottom surfaces, a plurality of spaced apart transversely extending generally rectangular passages extending through the elastomer member from one marginal edge to the other marginal edge, intermediate the top and bottom surfaces, each said openings having an indexing means on at least one side, a series of metal load bearing members equal in number to the number of passages and having the general shape of the transversely extending passages and slidable therein, said metal load bearing members having a cooperating indexing means engaging the indexing means in the passage to center the load bearing members in said passage, said load bearing members being shorter than the length of the passage and maintained in the passage substantially equidistant from the marginal edges by said indexing means but having a length sufficient to span the space between the roadway or bridge sections at all times, means included in the marginal side edges of said elastomer member for fastening the elastomer member to said spaced bridge or roadway sections and a plurality of longitudinally spaced slots on at least one of the marginal side edges and the top and bottom surfaces of the elastomer member.

2. An expansion joint and seal structure as claimed in claim 1 wherein the generally rectangular passages have rounded corners to provide a generally long oval cross section and the load bearing members have the same cross section.

3. An expansion joint and seal structure as claimed in claim 1 wherein the load bearing members are cast of graphitic steel.

4. An expansion joint and seal structure as claimed in claim 1 wherein the fastening means is a generally H-shaped metal member having a threaded bolt projecting centrally therefrom extending out of the marginal side edges between each transverse passage with the H member on its side and having the legs of the H member extending partially over and under adjacent passages.

5. An expansion joint and seal structure as claimed in claim 1 wherein the fastening means is a generally H-shaped member having a hole centrally thereof receiving a threaded bolt extending through said hole and through a hole in the elastomer member between each transverse passage with the H member on its side and having the legs of the H member extending partially over and under adjacent passages.

6. An expansion joint and seal structure as claimed in claim 1 wherein each marginal edge as at least one longitudinally extending slot extending lengthwise of said edge above the transverse passage and one below the transverse passage.

7. An expansion joint and seal structure as claimed in claim 1 wherein the top and bottom surfaces of the elastomer member each have spaced longitudinally extending slots.

8. An expansion joint and seal structure as claimed in claim 1 wherein the elongate elastomeric member has a plurality of spaced transverse slots on the bottom surface parallel to the center line of each fastening means and intersecting the longitudinal slots.

9. An expansion joint and seal structure for the variable width space between a pair of roadway, bridge or like sections which are subject to expansion and contraction with temperature changes comprising an elongate elastomeric member with generally parallel side marginal edges and generally parallel top and bottom surfaces, a plurality of spaced apart transversely extending generally rectangular passages extending through the elastomer member from one marginal edge to the other marginal edge, intermediate the top and bottom surfaces, each said openings having an indexing means on at least one side, a series of metal load bearing members equal in number to the number of passages and having the general shape of the transversely extending passages and slidable therein, said metal load bearing members having a cooperating indexing means engaging the indexing means in the passage to center the load bearing members in said passage, said load bearing members being shorter than the length of the passage and maintained in the passage substantially equidistant from the marginal edges by said indexing means but having a length sufficient to span the space between the roadway or bridge sections at all times, means included in the marginal side edges of said elastomer member for fastening the elastomer member to said spaced bridge or roadway sections, a plurality of longitudinally spaced slots on at least one of the marginal side edges and the top and bottom surfaces of the elastomer member and wherein the indexing means in the passage is an inwardly extending projection on the center of at least one side wall and the cooperating indexing means on the metal load bearing member is a like recess receiving said projection at the center of the load supporting member.

10. An expansion joint and seal structure for the variable width space between a pair of roadway, bridge or like sections which are subject to expansion and contraction with temperature changes comprising an elongate elastomeric member with generally parallel side marginal edges and generally parallel top and bottom surfaces, a plurality of spaced apart transversely extending generally rectangular passages extending through the elastomer member from one marginal edge to the other marginal edge, intermediate the top and bottom surfaces, each said openings having an indexing means on at least one side, a series of metal load bearing members equal in number to the number of passages and having the general shape of the transversely extending passages and slidable therein, said metal load bearing members having a cooperating indexing means engaging the indexing means in the passage to center the load bearing members in said passage, said load bearing members being shorter than the length of the passage and maintained in the passage substantially equidistant from the marginal edges by said indexing means but having a length sufficient to span the space between the roadway or bridge sections at all times, means included in the marginal side edges of said elastomer member for fastening the elastomer member to said spaced bridge or roadway sections, a plurality of longitudinally spaced slots on at least one of the marginal side edges and the top and bottom surfaces of the elastomer member and wherein the indexing means is a pair of opposed elastomeric projections on the two side walls of each passage at substantially the midpoint of said passage engageable in a pair of cooperating like shaped recesses in each load bearing member at substantially its midpoint.

11. An expansion joint and seal structure as claimed in claim 9 or 10 wherein the generally rectangular passages have rounded corners to provide a generally long oval cross section and the load bearing members have the same cross section.

12. An expansion joint and seal structure as claimed in claim 9 or 10 wherein the load bearing members are cast of graphitic steel.

13. An expansion joint and seal structure as claimed in claim 9 or 10 wherein the fastening means is a generally H-shaped metal member having a threaded bolt projecting centrally therefrom extending out of the marginal side edges between each transverse passage with the H member on its side and having the legs of the H member extending partially over and under adjacent passages.

14. An expansion joint and seal structure as claimed in claim 9 or 10 wherein the fastening means is a generally H-shaped member having a hole centrally thereof receiving a threaded bolt extending through said hole and through a hole in the elastomer member between each transverse passage with the H member on its side and having the legs of the H member extending partially over and under adjacent passages.

15. An expansion joint and seal structure as claimed in claim 9 or 10 wherein each marginal edge has at least one longitudinally extending slot extending lengthwise of said edge above the transverse passage and one below the transverse passage.

16. An expansion joint and seal structure as claimed in claim 9 or 10 wherein the top and bottom surfaces of the elastomer member each have spaced longitudinally extending slots.

17. An expansion joint and seal structure as claimed in claim 9 or 10 wherein the elongate elastomeric member has a plurality of spaced transverse slots on the bottom surface parallel to the center line of each fastening means and intersecting the longitudinal slots.

18. An expansion joint and seal structure for the variable width space between a pair of roadway, bridge or like sections which are subject to expansion and contraction with temperature changes comprising an elongate elastomeric member with generally parallel side marginal edges and generally parallel top and bottom surfaces, a plurality of spaced apart transversely extending generally rectangular passages extending through the elastomer member from one marginal edge to the other marginal edge, intermediate the top and bottom surfaces, each said openings having an indexing means on at least one side, a series of metal load bearing members equal in number to the number of passages and having the general shape of the transversely extending passages and slidable therein, said metal load bearing members having a cooperating indexing means engaging the indexing means in the passage to center the load bearing members in said passage, said load bearing members being shorter than the length of the passage and maintained in the passage substantially equidistant from the marginal edges by said indexing means but having a length sufficient to span the space between the roadway or bridge sections at all times and a plurality of longitudinally spaced slots on at least one of the marginal side edges and the top and bottom surfaces of the elastomer member.

19. An expansion joint and seal structure as claimed in claim 18 wherein the indexing means in the passage is an inwardly extending projection on the center of at least one side wall and the cooperating indexing means on the metal load bearing member is a like recess receiving said projection at the center of the load supporting member.

20. An expansion joint and seal structure as claimed in claim 18 wherein the indexing means is a pair of opposed elastomeric projections on the two side walls of each passage at substantially the midpoint of said passage engageable in a pair of cooperating like shaped recesses in each load bearing member at substantially its midpoint.

* * * * *

UNITED STATES PATENT AND TRADEMARK OFFICE

CERTIFICATE OF CORRECTION

PATENT NO. : 4,397,579

DATED : August 9, 1983

INVENTOR(S) : Gerald L. Goldman, Joseph W. Gallagher, William A. Merlack

It is certified that error appears in the above-identified patent and that said Letters Patent is hereby corrected as shown below:

Column 1, line 24, "or" should be --of--.

Column 4, line 1, "wlll" should be --well--.

Claim 13, column 6, line 19, "metal" should be deleted.

Signed and Sealed this

*Eighth* Day of *November 1983*

[SEAL]

*Attest:*

GERALD J. MOSSINGHOFF

*Attesting Officer*

*Commissioner of Patents and Trademarks*